United States Patent [19]

Tachikawa et al.

[11] Patent Number: 4,740,439

[45] Date of Patent: Apr. 26, 1988

[54] IMAGE-FORMING PROCESS USING LONG-ROLLED PHOTOSENSITIVE MATERIAL

[75] Inventors: Hiromichi Tachikawa; Syunichi Kondo; Masataka Murata; Hideo Sato, all of Kanagawa, Japan

[73] Assignee: Fuji Photo Film Co., Ltd.,, Kanagawa, Japan

[21] Appl. No.: 871,355

[22] Filed: Jun. 6, 1986

[30] Foreign Application Priority Data

Jun. 6, 1985 [JP] Japan ..... 60-123163

[51] Int. Cl.[4] ..... G03G 13/22

[52] U.S. Cl. ..... 430/54; 430/31; 430/56; 430/67; 430/273; 430/394; 430/501; 430/531; 430/934; 430/961

[58] Field of Search ..... 430/31, 54, 66, 67, 430/273, 394, 500, 501, 531, 934, 961

[56] References Cited

U.S. PATENT DOCUMENTS

| | | | |
|---|---|---|---|
| 2,976,144 | 3/1961 | Rose | 430/31 X |
| 3,390,620 | 7/1968 | Fairbanks | 430/31 X |
| 4,012,255 | 3/1977 | McMullen | 430/67 |
| 4,092,173 | 5/1978 | Novak et al. | 430/531 |
| 4,618,553 | 10/1986 | Yuyama et al. | 430/69 |

FOREIGN PATENT DOCUMENTS

| | | | |
|---|---|---|---|
| 53-63018 | 6/1978 | Japan | 430/67 |
| 53-111734 | 9/1978 | Japan | 430/67 |
| 54-1631 | 1/1979 | Japan | 430/67 |
| 56-38054 | 4/1981 | Japan | 430/67 |
| 58-102944 | 6/1983 | Japan | 430/67 |
| 933391 | 8/1963 | United Kingdom | 430/961 |
| 2016167 | 9/1979 | United Kingdom | 430/934 |

*Primary Examiner*—Roland E. Martin

*Attorney, Agent, or Firm*—Sughrue, Mion, Zinn, Macpeak, and Seas

[57] ABSTRACT

An image-forming process using a long rolled transparent light-sensitive recording material is disclosed. The process comprises applying at least two image-forming steps each including at least an image exposure and a development to a long rolled transparent light-sensitive recording material comprising a support having thereon a light-sensitive layer and a surface protective layer containing a hardenable compound and fine particles. The recording material preferably has a backing layer containing fine particles.

9 Claims, 1 Drawing Sheet

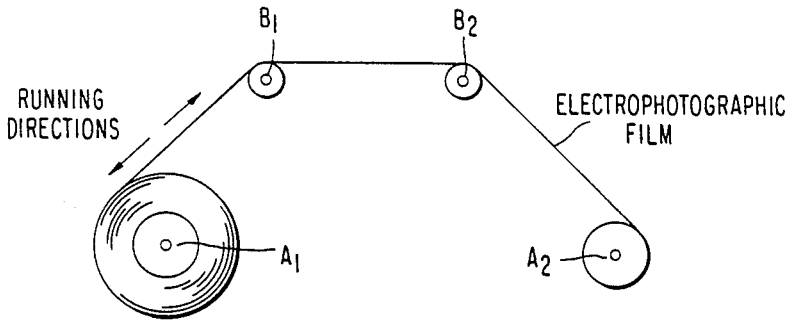
B1
B2
RUNNING
DIRECTIONS
ELECTROPHOTOGRAPHIC
FILM
A1
A2

IMAGE-FORMING PROCESS USING LONG-ROLLED PHOTOSENSITIVE MATERIAL

FIELD OF THE INVENTION

This invention relates to an image-forming process using a long rolled transparent light-sensitive recording material. More particularly, the present invention relates to an image-forming process always capable of forming images having good quality in a system of forming images at optional position(s) of the same light-sensitive recording material.

BACKGROUND OF THE INVENTION

Recently, the number of documents made in offices, etc., has become very enormous, and it has strongly been desired to develop a system capable of recording and reproducing these documents at any time.

Hitherto, as a long transparent light-sensitive material (the term "long rolled recording material" used in this invention means a recording material having the length to width ratio of more than 20/1) which is used in a rolled state, there are known cinema film and microfilm using silver halide, and film using a diazo compound. In order that after forming images at optional position(s) of the above-described light-sensitive recording material by applying thereto image exposure and development, images are formed at other portion(s) of the same recording material by repeating the same operation as above, very complicated steps and apparatus are required and it is very difficult for practical use to form images at optional position(s) of the above-described recording material at any time and repeatedly performing retrieving, projecting, and reading of the images thus recorded according to requirement.

As a system capable of forming images at any position(s) of the same recording material at any time, a system of using an electrophotographic recording material, a heat developing type light-sensitive material, or a post active type dry image forming material may be considered in principle. However, a system capable of forming images at optional positions of the same light-sensitive material at any time and retrieving, projecting and reading the recorded images according to requirement has not yet been sufficiently realized.

In such a system of forming images at optional positions of the same recording material at any time and repeatedly performing the operations such as retrieval, projection, reading, duplication, etc., of the images at any desired position of the recording material according to requirement, there are various problems. For example, in the system of using a long rolled recording material, it becomes inevitably necessary to run the recording material, and when a long rolled recording material is run, there are disadvantages such as that scratches, etc. form on the surface of the light-sensitive layer of the recording material due to contact between the recording material and rollers, guide pins, etc. necessary for moving and guiding the recording material, and also physical defects or delicate changes in the surface state, etc., such as transfer of the surface state of the back surface of the recording material onto the surface of the light-sensitive layer which is brought into contact with the back surface or the transfer of the surface state of the light-sensitive layer onto the back surface, the retransfer of materials once transferred onto guide rollers, etc., onto the surface of the light-sensitive layer, blocking on the surface of the light-sensitive layer, etc. occur, and , when images are newly formed after running the recording material, the quality of the new images is greatly reduced as compared with the images formed before running.

Also, when such a long rolled recording material is stored in the rolled state for a long period of time, defects such as the reduction in the quality of images, etc. occur by the direct contact of the light-sensitive layer of the recording material with the back surface thereof (e.g., due to the occurrence of blocking, etc.).

In particular, in the case of a recording material of the type that images are recorded as reduced images thereof, it is required to enlarge and project the images at reading, whereby the above-described defects are also enlarged to cause large problems.

In the case of an electrophotographic recording material, the surface state of the light-sensitive layer thereof is very important in the image forming process, as is well known. That is, in an electrophotographic process, after first uniformly electrostatically charging the surface of a light-sensitive layer, the light-sensitive layer is imagewise exposed to form latent images and the latent images are toner-developed. Accordingly, when even very delicate changes occur in the property or the state of the surface of the light-sensitive layer, they have large influences on the quality of images formed.

It is known to form a surface protective layer containing a hardenable compound or fine particles in an electrophotographic light-sensitive material. Examples of adding a hardenable compound are described in Japanese Patent Application (OPI) Nos. 30526/75, 3538/79, 1632/79, 40839/81, etc., and examples of adding fine particles are described in Japanese Patent Application (OPI) Nos. 26226/77, 38054/81, 229571/84, etc. (the term "OPI" as used herein means an "unexamined published Japanese patent application"). However, these protective layers are all for opaque (non light-transmissive) light-sensitive materials, and the purpose of them is in the capability of the repeated use of the same light-sensitive material (i.e., the improvement of the copying life) by preventing the occurrence of abrasion by the contact of the light-sensitive material onto which the toner images are transferred and the formation of scratches by the contact with toner particles or in a cleaning step.

In the case of ordinary plain paper copying (PPC), toner images formed on a light-sensitive recording material are transferred onto a paper, etc., to form images thereon. Accordingly, fine scratches and dust formed on the surface of the light-sensitive layer and microscopic defects in property or state on the surface of the light-sensitive material are not transferred onto the paper, etc., as enlarged defect images, and do not give serious disadvantages for practical use.

Also, in the case of PPC or CPC (coated paper copying) copying without employing the transfer of toner images, the enlargement and projection of the light-sensitive material itself are generally unnecessary at reading, and hence the above-described fine various defects on the light-sensitive material do not give any serious disadvantages for practical use.

However, in the case of directly utilizing images formed on a transparent (light transmissive) light-sensitive recording material without employing an image transfer process, even the above-described fine defects become large problems. In particular, in the system of recording images on a transparent light-sensitive recording materials as reduced or diminished images, the images are projected as enlarged images at reading and hence if, in such a case, various fine defects exist on the surface of the light-sensitive layer thereof, they become large problems for practical use.

In the case of forming images on a transparent light-sensitive recording material using the above-described electrophotographic process, the surface state of the light-sensitive layer thereof is important. In other words, when images are first formed at optional position(s) of a transparent light-sensitive recording material and then images are formed again at other position(s) of the same recording material after running the recording material from several dozen times to several thousand times of after storing the recording material in a rolled state for a long period of time, defects such as scratches, etc., as well as fine spot-like or image-like uneven densities are observed on the surface of the light-sensitive material. This results in reduction of the readability, and reductions in the resolving power of characters and in the quality of continuous tone images. In particular, in a microfilm system using a transparent electrophotographic recording material, the reduction of the quality of images is severe, and thus such images are unsuitable for practical use. This trouble is considered to be partially caused by scratches occurring during running or during the storage of the recording material in rolled state, attachment of dust on the surface of the light-sensitive layer, the occurrence of blocking, etc. In addition to these defects on the surface, other defects which are considered to be caused by delicate changes in property or state of the surface of the light-sensitive material unobservable by a microscope occur and it is very important for practical use to prevent the occurrence of such defects.

The inventors previously found that, in an image-forming process of performing image formation more than twice on the same light-sensitive material by a sequence of steps including at least image exposure and development, the above-described various defects could be substantially eliminated by forming on the surface of the light-sensitive material a surface protective layer containing a hardenable compound or a surface protective layer containing fine particles. The light-sensitive recording material having such a surface protective layer can be used without any trouble in practical purpose in a system of forming conventional microfilm images for recording originals mainly composed of line images such as characters or letters, etc. However, when a continuous tone image is formed on the light-sensitive material having the above-described surface protective layer after running the recording material or after storing the recording material in a rolled state for a long period of time, very fine uneven densities, etc. occur in what should be uniform density ranges, which results in reducing the quality of images as compared with the images formed on the same recording material before running or storage for a long period of time. For preventing the reduction in the quality of the continuous tone images in the case of forming the surface protective layer containing, for example, a hardenable compound, it may be considered to increase the content of the hardenable compound or the thickness of the protective layer, but even in such cases, the elimination of the aforesaid defects in the continuous images is insufficient, and additional problems, such as reduction in resolving power and changes in quality, etc., occur by the reaction of the hardenable compound and compound(s) in the light-sensitive layer. Also, in the case of forming the surface protective layer containing fine particles alone, the increase of the content of the fine particles or the thickness of the protective layer results in the reduction of resolving power or the reduction of the transparency of the recording material.

As described above, in a transparent light-sensitive recording material having a surface protective layer containing a hardenable compound or fine particles individually, it is difficult to eliminate fine uneven densities occurring on the continuous images formed thereon after running of the recording material or after storage of the recording material in a rolled state for a long period of time. Thus, in the case of forming continuous tone images on a long transparent light-sensitive recording material in a system of running the recording material, it is also required to overcome the above-described problems.

SUMMARY OF THE INVENTION

An object of this invention is, therefore, to prevent, in the case of performing more than twice an image formation by a sequence of steps including at least image exposure and development, the occurrence of scratches and attaching of dust occurring on the recording material before forming images after the first image formation step to prevent the reduction in quality of images after the first image formation step.

A particular object of this invention is to prevent the reduction in quality of continuous tone images formed after the first image formation step.

As a result of extensive investigations for eliminating the above-described disadvantages on images occurring in the case of forming the continuous tone images on a long transparent light-sensitive recording material in rolled state for performing at least twice an image formation including at least image exposure and development in the same recording material after running many times of the recording material or after storing the recording material in a rolled state for a long period of time, the inventors have discovered that the above-described various defects on images can be substantially eliminated by forming a surface protective layer containing a hardenable compound and fine particles on the surface of the light-sensitive layer formed on a support and have succeeded in attaining this invention.

In the light-sensitive recording material of this invention, it is preferred to form a backing layer containing the fine particles on the support of the recording material at the side opposite to the side carrying the light-sensitive layer. Also, in the case of forming the backing layer containing the fine particles, the surface protective layer in this invention may contain one of a hardenable compound and fine particles.

BRIEF DESCRIPTION OF THE DRAWING

FIGURE is a schematic view showing a running test apparatus for light-sensitive recording materials.

DETAILED DESCRIPTION OF THE INVENTION

This invention can be advantageously used for a long rolled transparent light-sensitive recording material, such as an electrophotographic recording material, a heat-developable light-sensitive recording material, or a post-active type dry image-forming material for performing at least twice an image formation including at least image exposure and development at optional positions of the same recording material. In particular, the invention can be advantageously used for an electrophotographic recording material of the aforesaid type, wherein the surface state is important.

This invention can be more advantageously used in the case of storing the recording material before forming images in a subsequent step on the same recording material after forming images on the recording material in the previous step or in the case of viewing the images already formed on the recording material in a system of repeatedly performing at least twice an image formation at optional positions and at any time on the same light-sensitive recording material by an electrophotographic recording system, a heat-developable light-sensitive recording system or a post-active type dry image-forming system as described in Japanese Patent Application (OPI) Nos. 149572/83, 23365/84, 210429/84, 28540/85, etc.

The invention can be particularly advantageously used in an electrophotographic recording system. In the case of an electrophotographic recording system, an electrostatic charging step is employed before image exposure and the electrostatic latent images formed by the image exposure are developed by an electrophotographic developer or a toner.

In addition, the term "at any time" as used in this invention means that there are no time restrictions on the image-forming operation by image exposure and development in the case of performing the operation at least twice. Also, the term "optional positions" as used in this invention means any positions of a long rolled transparent light-sensitive recording material in the lengthwise direction, wherein the image formation can be performed in any disired order or an irregular order.

Also, in a preferred embodiment of this invention, the application of magnetic or optical marks showing positions on the recording material in the longitudinal direction can be utilized for the indication of the positions on which images are formed or the retrieval of the images formed on the recording material.

The present invention is hereinafter described in detail.

The improved transparent light-sensitive recording material of this invention is composed of at least a support, a light-sensitive layer, and a surface protective layer. More preferably, the light-sensitive recording material of this invention further has a backing layer on the support on the side opposite to the light-sensitive layer carrying side.

There is no particular restriction on the support for use in this invention provided that the support is transparent and has flexibility, but in the case of an electrophotographic recording material, it is required that the support be subjected to a conductivity-providing treatment for rendering the support electrically conductive. Practical conductivity-providing treatment for use in this case include a method of vapor depositing a metal such as aluminum, gold, palladium, indium, etc., on the surface of the support; a method of vapor depositing thereon a metal oxide such as $In_2O_3$, $SnO_2$, etc.; a method of coating thereon a dispersion of a metal powder, etc., dispersed in a polymer binder; a method of coating a solution of an organic quaternary salt compound, etc., and a polymer binder, etc. Thus, a transparent plastic film thus imparted with conductivity can be used.

As a substantially transparent (light transmissive) light-sensitive material in this invention, various kinds of materials can be used.

For example, in the case of electrophotographic recording materials, organic photoconductors are preferably used. Examples of preferred organic photoconductors for use in this invention include various high polymers such as polyvinyl carbazole, polyvinyl pyrene, polyvinyl anthracene, poly-2-vinyl-4-(4'-dimethylaminophenyl)-5-phenyloxazole, poly-3-vinyl-N-ethylcarbazole, polyacenaphthylene, polyindene, pyrene-formaldehyde resin, an ethylcarbazole-formaldehyde resin, the triphenylmethane polymers described in Japanese Patent Application (OPI) No. 161550/81, and derivatives thereof, and various low molecular weight compounds such as triazole derivatives, oxadiazole derivatives, imidazole derivatives, polyarylalkane derivatives, pyrazoline derivatives, pyrazolone derivatives, phenylenediamine derivatives, arylamine derivatives, amino-substituted chalcone derivatives, N,N-bicarbazyl derivatives, oxazole derivatives, styrylanthracene derivatives, hydrazone derivatives, phthalocyanine derivatives, etc. Also, a combination of an organic photoconductor and a vapor-deposited thin layer of selenium, etc., can be used in this invention.

When the organic photoconductor is a low molecular weight compound, a high polymer having a suitable film-forming property can be used as a binder. Specific examples of the high polymer which can be used as the binder in this case are polyamide, polyurethane, polyester, an epoxy resin, polyketone, a styrenic polymer and copolymers, poly-N-vinyl carbazole, polycarbonate, polyester carbonate, polysulfone, a vinyl chloride resin, a vinylidene chloride resin, a vinyl acetate resin, an acryl resin, etc. When the organic photoconductor is a high polymer, the photoconductor itself has a film-forming property but, if necessary, the above-described high polymer may be used together.

For the above-described organic photoconductors, if desired, sensitizing dyes, chemical sensitizers, etc., can be used.

Examples of the sensitizing dyes are described in *Society of Photographic Scientists and Engineers,* Vol. 19, pp. 60–64 (1975); *Applied Optics.,* Vol. 3, p. 50 (1969); U.S. Patents Nos. 3,037,861, 3,250,615, and 3,712,811; British Pat. No. 1,353,264, *Research Disclosure,* RD No. 10938, 109, page 62 et seq. (May 1973), U.S. Pat. Nos. 3,141,700, 3,938,994, Japanese Patent Application (OPI) Nos. 14560/81, 14561/81, 29586/81, 29587/81, 65885/81, 114259/80, 35141/81, etc. The sensitizing dye can be suitably selected from these known sensitizing dyes and other dyes which can increase the sensitivity of the organic photoconductor.

For the organic photoconductor which is used for the light-sensitive recording material of this invention, a chemical sensitizer can also be used. Examples of such a chemical sensitizer are electron attractive compounds such as trinitrofluorenone, chloranil, tetracyanoethylene, etc., and the compounds described in Japanese Patent Application (OPI) Nos. 65439/83, 102239/83, etc., although the chemical sensitizers for use in this invention are not limited to these compounds.

The transparent electrophotographic recording material of this invention is prepared by dispersing or dissolving the above-described components in a suitable solvent to form a dispersion or a homogeneous solution and coating it on a transparent support having a proper conductive surface, followed by drying to form a light-sensitive layer. The thickness of the light-sensitive layer is preferably from 1 to 50 μm, and more preferably from 3 to 20 μm.

In addition to the above-described electrophotographic recording material, the substantially transparent light-sensitive recording material for use in this invention also includes the heat-developable light-sensitive materials described in Japanese Patent Publication Nos. 2096/63, 4921/68, 4924/68, 35484/79, 268/78, etc., and the postactive dry image-forming materials described in Japanese Patent Application (OPI) Nos. 25085/80, 153937/80, 67841/81, etc.

As the hardenable compound which can be used for the surface protective layer as one of the most important elements in this invention, various kinds of compounds can be used. For example, the compounds described in Kakyozai (*Crosslinking Agent*) *Handbook*, published by Taisei Sha, 1981, can be used as the hardenable compounds in this invention.

For example, for hardening the hardenable compound(s) in this invention, the following crosslinking methods can be employed. That is, there are a method of hardening a natural or synthetic rubber or a resin having unsaturated bonds, such as unsaturated polyester, an alkyd resin, etc., by oxidation or by a polymerization initiator, light, heat, etc., in the existence of an unsaturated monomer; a method of hardening an epoxy resin or an epoxy group-containing resin such as an epoxy group-containing acryl resin by polyamine, polyamide, polycarboxylic acid anhydride, etc.; a method of hardening a resin containing a hydroxy group, carboxy group, or amino group by the reaction thereof with a polyisocyanate; and a method of crosslinking a self-crosslinking polyisocyanate.

In this invention, a crosslinking agent or hardening agent having an isocyanate group as the crosslinking component is advantageously used as the hardenable compound in this invention. Examples of these crosslinking agents include polyisocyanate type crosslinking agents such as triphenylmethane triisocyanate, diphenylmethane diisocyanate, toluylene diisocyanate, 2,4-toluylene diisocyanate, naphthylene-1,5-diisocyanate, o-toluylene diisocyanate, polymethylenepolyphenyl isocyanate, hexamethylene diisocyanate, etc., and polyisocyanate adduct-type crosslinking agents such as a trimethylolpropane adduct of tolylene diisocyanate, an adduct of hexamethylene diisocyanate and water, an adduct of trimethylolpropane and xylylene diisocyanate, etc. These agents may be used solely or as a mixture thereof. Furthermore, the aforesaid crosslinking agent(s) can be used as a mixture thereof with a compound having a reactive group such as a hydroxy group, a carboxy group, or an amino group. Examples of the compound which can be used together with the crosslinking agent include 1,4-butanediol, ethylene glycol, polyether polyol, polyester-type polyol, acryl-type polyol, epoxy resin-type polyol, 4,4'-methylenebis(2-chloroaniline), hydroxypropylated ethylenediamine, etc.

In addition to the above-described moisture-hardenable type or two-part mixing type isocyanate compounds, block-type isocyanates blocked by phenols such as phenol, cresol, etc., or alcohols can be used as the harndenable compound in this invention.

As fine particles which are another important element for consisting the protective layer and/or the backing layer, various kinds of fine particles can be used. Examples thereof include fine particles of an inorganic insulating material such as silica, calcium carbonate, mica, clay, boron nitride, molybdenum disulfide, etc., fine particles of a metal such as aluminum, iron, copper, nickel, etc., fine particles of a metal oxide such as titanium oxide, aluminum oxide, magnesium oxide, zinc oxide, tin dioxide, bismuth oxide, indium oxide, antimony oxide, etc., fine particles of a long chain organic acid salt of a metal, fine polymer particles, etc. Of these fine particles, the fine particles of silica, aluminum oxide, or titanium oxide are preferably used.

Examples of silica for use in this invention include Aerosil 130, Aerosil 200, Aerosil 380, Aerosil OX50, Aerosil TT-60, and Aerosil R972 (trademarks for products made by Nippon Aerosil K.K.), Syloid 266, Syloid 244, Syloid 255, and Syloid 308 (trademarks for products made by Fuji-Devison Chemical Ltd.), Tokusil GV (trademark for product made by Tokuyama Soda Co., Ltd.), Carplex (trademark for product made by Shionogi & Co., Ltd.), etc.

Examples of titanium oxide particles for use in this invention include fine particles such as Titanium Oxide P25 (trademark for product made by Nippon Aerosil K.K.), etc.

Also, MOX 80, MOX 170, COK 84, etc. (trademarks for products made by Nippon Aerosil K.K.), which are a mixture of aluminum oxide and silica, can also be used as the fine particles in this invention.

Also, examples of the long organic acid metal salt for use in this invention as fine particles thereof include sodium laurate, calcium laurate, barium laurate, magnesium laurate, lead laurate, zinc laurate, aluminum laurate, lithium laurate, sodium stearate, calcium stearate, barium stearate, magnesium stearate, lead stearate, zinc stearate, aluminum stearate, lithium stearate, sodium myristate, calcium myristate, barium myristate, magnesium myristate, lead myristate, zinc myristate, aluminum myristate, lithium myristate, sodium behenate, calcium behenate, barium behenate, magnesium behenate, lead behenate, zinc behenate, aluminum behenate, lithium behenate, lithium 12-hydroxystearate, sodium oleate, stearyl acid phosphate, magnesium stearyl acid phosphate, aluminum stearyl acid phosphate, calcium stearyl acid phosphate, zinc stearyl acid phosphate, aluminum lauryl acid phosphate, zinc lauryl acid phosphate, sodium laurylsulfonate, sodium stearylsulfonate, zinc laurylsulfonate, zinc stearylsulfonate, calcium laurylsulfonate, calcium stearylsulfonate, barium laurylsulfonate, barium stearylsulfonate, etc., although they are not limited to the aforesaid materials.

Examples of fine polymer particles include fine particles of polypropylene, polyethylene, polyamide, polyvinylidene fluoride, polytetrafluoroethylene, polystyrene, etc.

More specifically, examples of fine particles of polyethylene include Flothene UF-80 (trademark for product by by Seitetsu Kagaku Kogyo K.K.), Micro sphere (trademark for product made by Nisshin Kasei K.K.), Micro balloon FTD-202 (trademark for product made by Toyo Soda Manufacturing Co., Ltd.), polyethylene made by Applied Chemistry Co. Examples of fine particles of polytetrafluoroethylene include Lubron L-5, Lubron L-2, Lubron LD-1, Lubron LD-100, and Lubron LA (trademark for products made by Daikin Kogyo Co., Ltd.), etc. Examples of fine particles of polyvinylidene fluoride include polyvinylidene fluoride (made by Kureha Chemical Industry Co., Ltd.), etc.

These fine particles may be used alone or a mixture of two or more kinds thereof. In this fine particles, the fine particles of silica, aluminum oxide, titanium oxide, long chain organic acid metal salts, and the fine polymer particles are preferred and further the fine particles of silica, aluminum oxide, or titanium oxide are particularly preferred.

There is no particular restriction on the mean particle size of the fine particles for use in this invention, but it is preferred that the mean particle size thereof is in the range of from 0.005 to 5 μm. If the mean particle size is larger than the aforesaid range, the transparency of the light-sensitive recording material and the image qualities of images formed, such as the resolving power, etc., are undesirably reduced. On the other hand, if the mean particle size is less than the aforesaid range, the protective effect of the layer becomes less.

For the surface protective layer and/or the backing layer in this invention, a non-hardenable resin binder can be used together with the above-described components. Examples of the resin binder for use in this invention include polyester carbonate, polysulfone, polyether, polyester, polycarbonate, polyamide, polyimide, polyurethane, acrylic acid ester polymer of copolymer, methacrylic acid ester polymer or copolymer, a styrene resin, polyvinyl acetal, polyvinyl carbazole, a vinyl chloride resin, a vinylidene chloride resin, chlorinated polyolefin, a vinyl acetate resin, an alkyd resin, a xylene resin, a ketone resin, celluloses, etc., although the resin binders for use in this invention are not limited to these materials. These materials can be used alone or as a mixture thereof.

In this invention, the thickness of the surface protective layers or the backing layer is generally from 0.01 to 20 μm, preferably from 0.1 to 5 μm, and more preferably from 0.1 to 1 μm. If the thickness is thinner than the above range, the protective effect becomes less, and if the thickness is thicker than the above range, residual potential is increased and the resolving power is reduced.

In the case of incorporating the fine particles in the surface protective layer in this invention, it is preferred that the content of the fine particles is in the range of from 1 to 85% by weight, and more preferably 3 to 50% by weight, of the solid components in the surface protective layer.

In the case of incorporating the hardenable compound in the protective layer, the layer may be formed by using the hardenable compound without using the above-described resin binder. Thus, in the case of using the hardenable compound and the fine particles for the protective layer, the fine particles and the hardenable compound are generally used in the proportions of 1 to 85% by weight and 99 to 15% by weight, respectively.

Also, in the case of using the resin binder, less than 99.5% by weight of the hardenable compound can be replaced with the resin binder.

Furthermore, in the case of forming the backing layer in this invention, the backing layer can be constituted by the fine particles and the resin binder. In this case, it is preferred that the content of the fine particles is from 1 to 85% by weight, and more preferably from 3 to 50% by weight, of the solid components in the backing layer.

Moreover, the surface protective layer in this invention may contain, if desired, various additives such as plasticizers, etc., for improving the properties of the layer.

The surface protective layer in this invention can be formed by uniformly dispersing the above-described components in a solvent and coating on a light-sensitive layer at a desired thickness followed by drying.

The transparent light-sensitive recording material of this invention may have an interlayer between the support and the light-sensitive layer or between the light-sensitive layer and the surface protective layer for various purposes such as the improvement of adhesion, etc.

The transparent light-sensitive recording material of this invention may further have a layer on the back side thereof for improving various characteristics such as the sliding property, electrostatic charging property, antiblocking property, etc.

The formation of images can be achieved by any of conventional electrophotographic methods, for example, the method as described by R. M. Schaffert, *Electrophotography,* Fifth Impression, 1980, Focal Press, London, pp. 27–93. More specifically, the surface of electrophotographic light-sensitive material is charged positively or negatively using a corona charger, etc., and then is imagewise exposed to light to form a static latent image. The image is then visualized by development which can be conducted by any one of various conventional methods, such as the development using dry toner or wet toner, or the powder cloud method. In order to reproduce a fine image or an image having gradation, the liquid development method using wet toner is preferably used. Fixing of the visualized image can also be achieved by a conventional method, for example, by heat fixing using hot air, a heat roller, etc., or using radiation of infrared rays, light, flash light, or high frequency; liquid fixing using a vapor of solvents having affinity to developers or light sensitive materials; press fixing using a press roller, etc.

The following examples are intended to illustrate the present invention, but not to limit it in any way.

EXAMPLE 1

A uniform dispersion was prepared by dispersing 3 g of zinc stearate, 15 g of triacetyl cellulose, and 500 ml of methylene chloride in a ball mill for 10 hours. The back surface of a commercially available conductive film TJ-100 (trademark for production made by Teijin Limited) was subjected to corona discharging surface treatment and the above-described dispersion was coated on the surface to form a backing layer of 0.5 m in thickness. Then, 10 g of organic photoconductor (I) shown below, 0.1 g of sensitizing dye (II) shown below, 18 g of polycarbonate ("Lexan 121-111", trademark for product made by General Electric Co.), and 2 g of a polyester resin ("Vylon 200", trademark for product made by Toyo Spinning Co., Ltd.) were dissolved in 150 ml of methylene chloride, and the solution was coated on the conductive surface of the above-described support in a thickness of 15 μm.

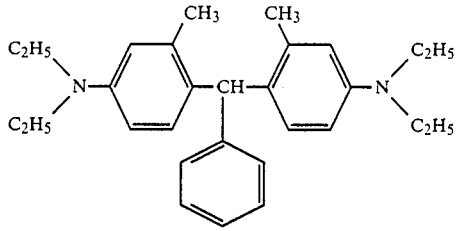

(I)

-continued (II)

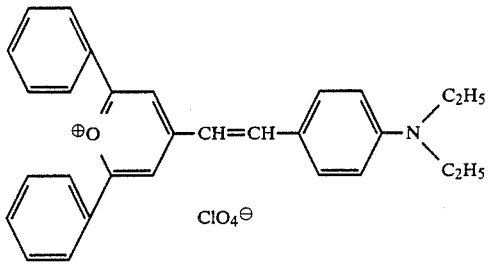

Then, 2 g of an isocyanate series hardening agent ("Coronate L", trademark for product made by Nippon Polyurethane Co., Ltd.), 1.5 g of titanium oxide ("Titanium Oxide P25, trademark for product made by Nippon Aerosil K.K.), 6 g of polymethyl methacrylate ("Dianal BR-83", trademark for product made by Mitsubishi Chemical Industries, Ltd.), and 500 ml of methyl ethyl ketone were uniformly dispersed, and the dispersion was coated on the aforesaid light-sensitive layer to form a surface protective layer having a thickness of 1 μm, thereby to prepare transparent electrophotographic film (A) was prepared.

Then, by following the same procedure as above except that only the isocyanate hardening agent was removed from the surface protective layer, transparent electrophotographic film (B) was prepared, and also by following the same procedure as above except that only the titanium oxide was removed from the protective layer, transparent electrophotographic film (C) was prepared.

Each of the transparent electrophotographic films (A), (B), and (C) thus prepared was slit into a long film of 16 mm in width. Each of the long films thus prepared was electrostatically charged at +700 volts and after applying thereto a reduced image exposure using a reflection original, the electrostatic latent images thus formed were developed using a liquid developer ("Ricoh MRP", trademark for product made by Ricoh Company, Ltd.) and the images thus formed were thermally fixed.

Then, repeatedly running 2,000 times the electrophotographic film at a speed of 1 meter/sec. in the running test device shown in Figure, images were formed by following the same procedure as above at the positive near the position of the image formed before. When the image of each of the elctrophotographic films (A), (B) and (C) thus obtained was observed by enlarged projection at 22 times, the images obtained showed good quality as the images formed before running without having defects in the images caused by scratches, dust, etc., or uneven densities based on fine spots, etc., not only in images composed mainly of line images, but also in images having continuous tone.

EXAMPLE 2

An electrophotographic film was prepared by following the same procedure as described in Example 1 except that silica ("Aerosil R972", trademark for product made by Nippon Aerosil K.K.) was used in place of the titanium oxide P25 used for the protective layer in Example 1, and the images thereof formed before and after running as described in Example 1 were evaluated. The images obtained on the film after running showed very good quality, substantially similar to that of the images formed before running.

EXAMPLE 3

An electrophotographic film was prepared by following the same procedure as described in Example 1 except that a protective layer composed of a dispersion of 6 g of polyvinylbytyral ("Denkabutyral 2000-", trademark for product made by Denki Kagaku Kogyo K.K.), 1 g of toluylene diisocyanate, 1.5 g of silica ("Syloid 244", trademark for product made by Fuji-Devison Chemical Ltd.), and 500 ml of methyl ethyl ketone was employed in place of the surface protective layer in Example 1, and the image qualities before and after running wee evaluated. The image quality of the images formed after the running test was very good, substantially similar to that of the images formed before the running test.

EXAMPLE 4

An electrophotographic film was prepared by following the same procedure as described in Example 1 except that a protective layer composed of a dispersion of 6 g of an epoxy resin ("Epicoat 100L", trademark for product made by Shell Kagaku K.K.), 0.3 g of diethylenetriamine, 1.5 g of aluminum oxide ("Aluminium Oxide C", trademark for product made by Nippon Aerosil K.K.), and 500 ml of methyl ethyl ketone was employed in place of the surface protective layer in Example 1, and the images before and after running were evaluated. The image quality of the images formed after the running test was very good, substantially similar to that of the images formed before the running test.

EXAMPLE 5

An electrophotographic film was prepared by following the same procedure as described in Example 1 except that a protective layer composed of a dispersion of 4 g of an epoxy resin ("Epicoat 1004", trademark for product made by Shell Kagaku K.K.), 2 g of a polyamide resin ("Versamide 115", trademark for product made by Henkel Nippon K.K.), 1.5 g of fluorine resin particles ("Lubron L-2", trademark for product made by Daikin Kogyo Co., Ltd.), and 500 ml of methyl ethyl ketone was employed in place of the surface protective layer used in Example 1, and the images before and after running were evaluated. The image quality of the images formed after the running test was very good, substantially similar to that of the images formed before the running test.

EXAMPLE 6

An electrophotographic film was prepared by following the same procedure as described in Example 1 except that a protective layer composed of a dispersion of 5 g of polyvinylbutyral ("Denkabutyral 3000-K", trademark for product made by Denki Kagaku Kogyo K.K.), 2 g of an isocyanate series hardening agent ("Desmodur AP Stable", trademark for product made by Sumitomo Bayer Co.), 2 g of silica ("Aerosil 130", trademark for product made by Nippon Aerosil K.K.), and 500 ml of methyl ethyl ketone was employed in place of the surface protective layer, and the images before and after running were evaluated. The image quality of the images formed after the running test was very good, substantially similar to that of the images formed before the running test.

EXAMPLE 7

An electrophotographic film was prepared by following the same procedure as described in Example 1 except that a protective layer composed of a dispersion of 5 g of a polyisocyanate prepolymer ("Desmodur KN", trademark for product made by Sumitomo Bayer Co.), 1.5 g of silica ("Aerosil R972, trademark for product made by Nippon Aerosil K.K.), and 500 ml of ethyl acetate was employed in place of the surface protective layer used in Example 1, and the images before and after running were evaluated. The image quality formed after the running test was very good, substantially similar to that of the images formed before the running test.

EXAMPLE 8

An electrophotographic film was prepared by following the same procedure as described in Example 1 except that a protective layer composed of a dispersion of 3 g of an alkyd resin ("Styresol 4440", trademark for product made by Nippon Reichfold Chemicals, Inc.), 3 g of polystyrene ("Piccolastic C-100", trademark for the product made by Esso Standard Oil Co.), 0.15 g of silica ("Aerosil R972", trademark for product made by Nippon Aerosil K.K.), and 500 ml of ethyl acetate was employed as the surface protective layer, and the images before and after running were evaluated. The image quality of the images formed after the running test was very good, substantially similar to that of the images formed before the running test.

EXAMPLE 9

A uniform dispersion was prepared by dispersing 3 g of zinc stearate, 15 g of triacetyl cellulose, and 500 ml of methylene chloride in a ball mill for 10 hours. One surface of a polyethylene terephthalate film was subjected to a corona discharging treatment, and the above-described dispersion was coated on the treated surface to form a backing layer of 0.5 μm in thickness. Then, on the opposite surface thereof was coated a coating liquid of 10 g of nitrocellulose dissolved in 300 ml of acetate and dried to form an interlayer of 0.3 μm in thickness. 3 g of silver benehate was added to 20 g of a mixture of toluene and methyl ethyl ketone (½ by volume ratio), and the mixture was dispersed for about 20 hours in a ball mill to provide a uniform silver behenate suspension. Then, a silver behenate emulsion was prepared by adding the following composition (I) to 1.5 g of the silver behenate suspension.

Composition (I)

| | |
|---|---|
| Methyl ethyl ketone solution of 10% by weight polyvinylbutyral | 2.0 g |
| Methanol solution of mercury acetate (100 mg/0.3 ml) | 0.15 ml |
| α,α,α',α'-Tetrabromo-o-xylene | 25 mg |
| Triphenyl Phosphite | 3 mg |
| Boron | 8 mg |
| Diphenylbromomethane | 4 mg |
| Quinoline | 30 mg |

The silver behenate emulsion thus prepared was coated on the interlayer on the support described above through an orifice of 100 μm, and then dried. Then, about 2 g of a reducing agent-containing solution composed of the following composition (II) was coated thereon through an orifice of 75 μm and dried to provide a post-active type dry image-forming light-sensitive film.

Composition (II)

| | |
|---|---|
| Cellulose Acetate | 6.3 g |
| 2,2'-Methylene-bis(4-ethyl-6-t-butylphenol) | 3.5 g |
| Phthalazinone | 1.2 g |
| Acetone | 83 g |

Then, after dispersing 6 g of polyvinylbutyral ("Denkabutyral 2000-L", trademark for product made by Denki Kagaku Kogyo K.K.), 1 g of toluylene diisocyanate, 1.5 g of silica ("Aerosil R972", trademark for product made by Nippon Aerosil K.K.), and 500 ml of methyl ethyl ketone, the dispersion was coated on the above-described light-sensitive material to form a surface protective layer of about 1 μm in thickness. The light-sensitive film thus prepared was slit into 16 mm widths to provide long film. After heating such film to 100° C. for 5 seconds, a reduction image exposure was applied to the film using a reflection original, and then the film was further heated to 120° C. for 5 seconds. After repeatedly applying 2,000 times a running test using the apparatus shown in FIGURE, images were formed again on the film in the same manner as described above. The image quality of the images formed after the running test was very good, substantially similar to that of the image formed before the running test.

EXAMPLES 10 TO 12

By following the same procedure as in the case of forming the backing layer in Example 1, except that each of the fine particles shown in Table 1 below was used in place of zinc stearate for the backing layer in Example 1, and each of the binder resins shown in Table 1 was used in place of triacetyl cellulose for the backing layer, each of the backing layers of examples 10 to 12 was formed and also by forming the surface protective layer as in each of the electrophotographic films (A), (B), and (C) in Example 1, each of the electrophotographic films of Examples 10 to 12 was prepared.

TABLE 1

| | Fine Particles | Binder Resin |
|---|---|---|
| Example 10 | Barium Stearate (made by Sakai Kagaku K.K.) 3 g | Cellulose Acetate (L-30, made by Daicel Chemical Industries, Ltd.) 15 g |
| Example 11 | Fluorine Resin Particles (Lubron L-5, made by Daikin Kogyo Ltd.) 3 g | Polyvinyl butyral (Denkabutyral 2000-L, made by Denki Kagaku Kogyo K.K.) 15 g |
| Example 12 | Silica (Syloid (169, made by Fuji-Devison Chemical Ltd.) 3 g | Polystyrene Resin (Piccolastic C-100, made by Esso Standard Oil Co.) 15 g |

Images were formed on each of these electrophotographic films thus prepared as in Example 1 and the images before and after running were evaluated. The image quality of the images formed after the running test as in Example 1 was very good, substantially similar to that of the images formed before the running test.

EXAMPLE 13

Electrophotographic films (D), (E) and (F) were prepared, respectively, by following the same procedures as in the cases of preparing electrophotographic films (A), (B), and (C) in Example 1, except that the backing layers were not formed.

When images were formed on each of the electrophotographic films and the images before and after running was evaluated as in Example 1, the image quality of the images formed after the running test was very good substantially the same as that of the images formed before the running test in electrophotographic film (D). However, in the case of electrophotographic films (E) and (F), spot-like density reductions occurred in some places thereon after the running test, and the image quality was reduced to some extent.

COMPARISON EXAMPLE 1

A comparison electrophotographic film was prepared by following the same procedure as in the case of preparing electrophotographic film (A) in Example 1 except that the surface protective layer was not formed, and the images before and after running were evaluated in the same manner as described in Example 1. In the images formed after the running test, uneven densities of various formed were observed. When the images were projected as the enlarged images, the letters of the images were only partially complete, which made the letters unreadable, and hence the images were unsuitable for practical use.

COMPARISON EXAMPLE 2

A comparison electrophotographic film was prepared by following the same procedure as in the case of preparing electrophotographic film (B) in Example 1. Then, the images before and after running were evaluated in the same manner as in Example 1. When the line images mainly composed of letters, etc., formed after the running test were projected as enlarged images, they were readable and there was no problem for practical use. However, in the case of images having continuous tone, spot-like density reduction was observed in the low-density ranges, and the images formed after the running test were lower in quality as compared to the images formed before the running test.

COMPARISON EXAMPLE 3

A comparison electrophotographic film was prepared by following the same procedure as in the case of preparing electrophotographic film (C) in Example 1, except that the backing layer was not formed. Then, the images before and after running were evaluated in the same manner as in Example 1. When the original was line images mainly composed of letters, etc., there was no problem for practical use in the case of projecting the images as the enlarged images. However, in the case of an original having continuous tone, spot-like density reduction was observed in the low-density region, and the images formed after the running test were lower in quality than that of the images formed before the running test.

While the invention has been described in detail and with reference to specific embodiments thereof, it will be apparent to one skilled in the art that various changes and modifications can be made therein without departing from the spirit and scope thereof.

What is claimed is:

1. An image-forming process which comprises applying a least two image-forming steps each including at least an image exposure and a development to a long rolled transparent light-sensitive recording material comprising a support having on one surface a light-sensitive layer and a surface protective layer having a thickness of from 0.01 to 20 μm and on another surface a backing layer having a thickness of from 0.01 to 20 μm, wherein said surface protective layer contains at least one of fine particles having a mean particle size in the range of from 0.005 to 5 μm and a hardenable compound and said backup layer contains fine particles having a mean particle size in the range of from 0.005 to 5 μm, and wherein the transparent light-sensitive recording material is an electrophotographic recording material wherein the support is an electrically conductive support and the light-sensitive layer is an electrophotographic light-sensitive layer.

2. An image-forming process as in claim 1, wherein the hardenable compound is an epoxy group-containing compound or an isocyanate compound.

3. An image-forming process as in claim 1, wherein the hardenable compound is a moisture-hardening type or a two-part mixing type isocyanate compound.

4. An image-forming process as in claim 1, wherein the fine particles are fine particles of silica, aluminum oxide, or titanium oxide.

5. An image-forming process as in claim 1, wherein the fine particles are fine particles of a long chain organic acid metal salt or fine polymer particle.

6. An image-forming process as in claim 1, wherein the surface protective layer contains fine particles in an amount of from 1 to 85% by weight of the total solid components thereof, and the backing layer contains the fine particles in an amount of from 1 to 85% by weight of the total solid components thereof.

7. An image-forming process as in claim 1, wherein the surface protective layer contains hardenable compound in an amount of from 0.5 to 100% by weight of the total solid components thereof and the backing layer contains the fine particles in an amount of from 1 to 85% by weight of the total solid components thereof.

8. An image-forming process as in claim 1, wherein the the thickness of each of the surface protective layer and the backing layer is from 0.1 to 5 μm.

9. An image-forming process as in claim 1, wherein the surface protective layer contains both the fine particles and the hardenable compound.

* * * * *